US006998932B2

(12) United States Patent
Taguchi et al.

(10) Patent No.: US 6,998,932 B2
(45) Date of Patent: Feb. 14, 2006

(54) HIGH-FREQUENCY SWITCH

(75) Inventors: Yutaka Taguchi, Ibaraki (JP); Yuki Satoh, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 56 days.

(21) Appl. No.: 10/809,309

(22) Filed: Mar. 24, 2004

(65) Prior Publication Data

US 2004/0189420 A1 Sep. 30, 2004

(30) Foreign Application Priority Data

Mar. 28, 2003 (JP) ..... 2003-091173

(51) Int. Cl.
*H01P 1/10* (2006.01)
*H01P 5/12* (2006.01)

(52) U.S. Cl. ..... 333/101; 333/103

(58) Field of Classification Search ..... 333/101, 333/103, 161; 330/51; 455/78
See application file for complete search history.

(56) References Cited

U.S. PATENT DOCUMENTS 5,625,894 A * 4/1997 Jou ..... 455/78
6,313,700 B1 * 11/2001 Nishijima et al. ..... 330/51
6,356,166 B1 * 3/2002 Goldsmith et al. ..... 333/161
6,856,213 B1 * 2/2005 Tsurunari et al. ..... 333/133
6,903,623 B1 * 6/2005 Jain ..... 333/103

FOREIGN PATENT DOCUMENTS

JP 07-074672 3/1995

* cited by examiner

*Primary Examiner*—Dean Takaoka
(74) *Attorney, Agent, or Firm*—RatnerPrestia

(57) ABSTRACT

A high-frequency switch having two input terminals and two output terminals of which a broad pass band is required has (i) a circuit board that has two input electrodes along one side and two output electrodes along another side, and (ii) four PIN diodes mounted on this circuit board. Each side of the quadrangle made by connecting the input electrodes and the output electrodes is not parallel to the corresponding side of the quadrangle made by connecting electrodes for mounting the PIN diodes. Each side and the corresponding side form an angle other than 180°. This structure can provide a high-frequency switch capable of reducing a transmission loss in the paths and facilitating impedance matching.

11 Claims, 6 Drawing Sheets

HIGH-FREQUENCY SWITCH

FIELD OF THE INVENTION

The present invention particularly relates to a high-frequency switch having two input terminals and two output terminals of which a broad pass band is required.

BACKGROUND OF THE INVENTION

As shown in FIG. 5, a high-frequency switch having two input terminals and two output terminals is used to switch two antenna terminals (hereinafter referred to simply as "terminals") 111 and 112 to transmitting terminal (terminal) 113 and receiving terminal (terminal) 114. In other words, in state 1 shown by solid line arrows, terminals 111 and 113, and terminals 112 and 114 are connected respectively. Alternatively, in state 2 shown by broken line arrows, terminals 112 and 113, and terminals 111 and 114 are connected respectively. Known are high-frequency switches using so-called compound semiconductors, such as GaAs, or those using p-intrinsic-n (PIN) diodes. As shown in FIG. 6, a PIN diode passes current when voltage in the forward direction is applied thereto, and does not pass current when voltage in the reverse direction is applied thereto. Such a high-frequency switch is disclosed in the Japanese Patent Unexamined Publication No. H07-74672, for example.

FIG. 7 shows a layout diagram of electronic components in a conventional high-frequency switch. PIN diodes 121, 122, 123, and 124, inductors 131, 132, 133, and 134, by-pass capacitors 141, 142, 143, and 144, and resistors 151, 152, 153, and 154 are disposed on the surface layer of circuit board (board) 170.

In a case that a high-frequency switch is structured of PIN diodes, the PIN diodes are connected as shown in FIG. 8. If this configuration is applied to the arrangement of FIG. 7, terminals 111 and 112 on the input side and terminals 113 and 114 on the output side are not disposed in the opposite configuration of FIG. 5. For this reason, the high-frequency switch is extremely user-unfriendly. To solve this problem, pattern wirings are routed on the inner layer of board 170 as shown in FIG. 9. In other words, by routing from terminal 111 to electrode 111A, terminal 112 to electrode 112A, terminal 113 to electrode 113A, and terminal 114 to electrode 114A, the terminals are interchanged. Thus, terminals 111 and 112 on the input side and terminals 113 and 114 on the output side are connected to input and output terminals of PIN diodes 121, 122, 123, and 124.

However, interchanging the terminals in this manner increases the length of the wiring patterns and a transmission loss, thus making impedance matching difficult.

SUMMARY OF THE INVENTION

A high-frequency switch of the present invention includes (i) a circuit board having two input electrodes along one side and two output electrodes along another side, and (ii) four PIN diodes mounted on the circuit board. Moreover, each side of the quadrangle made by connecting the input electrodes and output electrodes is not parallel to the corresponding side of the quadrangle made by connecting electrodes having the PIN diodes mounted thereon. Each side is at an angle other than 180° to the corresponding side.

DETAILED DESCRIPTION OF THE INVENTION

Figure 1:
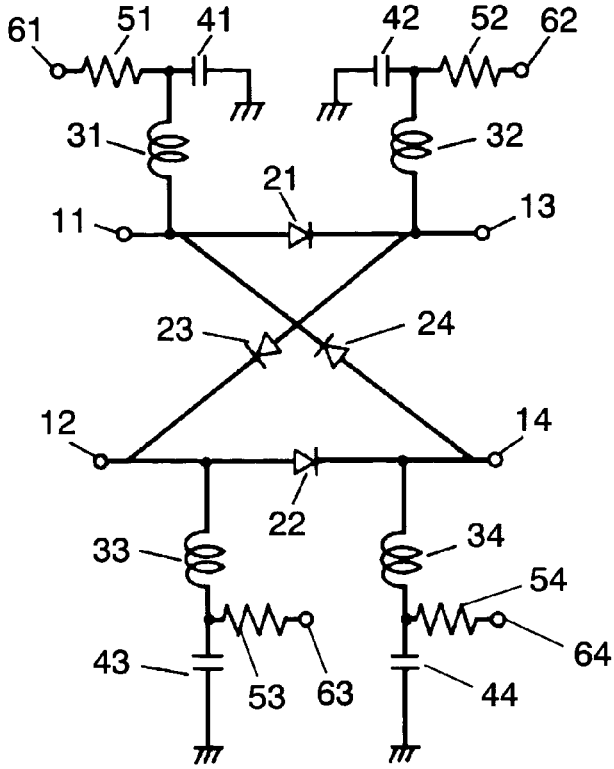
FIG. 1 is a circuit diagram of a high-frequency switch in accordance with an exemplary embodiment of the present invention.

FIG. 1 is a circuit diagram of a high-frequency switch in accordance with an exemplary embodiment of the present invention. This high-frequency switch has antenna terminals (herein after referred to simply as "terminals") 11 and 12, transmitting terminal (terminal) 13, and receiving terminal (terminal) 14. Additionally, the high-frequency switch has PIN diodes 21, 22, 23 and 24 as switches. Moreover, the high-frequency switch has inductors 31, 32, 33 and 34 for applying DC voltages to PIN diodes 21, 22, 23, and 24, respectively. The high-frequency switch also has by-pass capacitors 41, 42, 43, and 44 and resistors 51, 52, 53, and 54 for limiting the current through the respective diodes. Further, the high-frequency switch has power source terminals (terminals) 61, 62, 63, and 64 for supplying current through the respective diodes. Inductors 31 through 34, capacitors 41 through 44, and resistors 51 through 54 are passive components for controlling diodes 21 through 24.

Next, a description is provided of the operation of this circuit. A voltage of 3V is applied to terminals 61 and 63, and terminals 62 and 64 are grounded. Resistors 51, 52, 53, and 54 have a resistance such that a current of 5 mA, for example, passes through diodes 21, 22, 23, and 24, respectively. In this state, voltage in the forward direction is applied to diodes 21 and 22, thus causing current through the diodes. On the other hand, voltage in the reverse direction is applied to diodes 23 and 24, thus causing no current through the diodes. Therefore, a high frequency signal fed into terminal 11 is supplied to terminal 13, and is not supplied to terminals 12 or 14. Similarly, a high frequency signal fed into terminal 12 is supplied to terminal 14, and is not supplied to terminals 11 or 13.

Next, a voltage of 3V is applied to terminals 62 and 64, and terminals 61 and 63 are grounded. In this case, voltage in the forward direction is applied to diodes 23 and 24, thus causing current through the diodes. In contrast, voltage in the reverse direction is applied to diodes 21 and 22, thus causing no current through the diodes. Therefore, a high frequency signal fed into terminal 11 is supplied to terminal 14, and is not supplied to terminals 12 or 13. Similarly, a high frequency signal fed into terminal 12 is supplied to terminal 13, and is not supplied to terminals 11 or 14.

Figure 2:
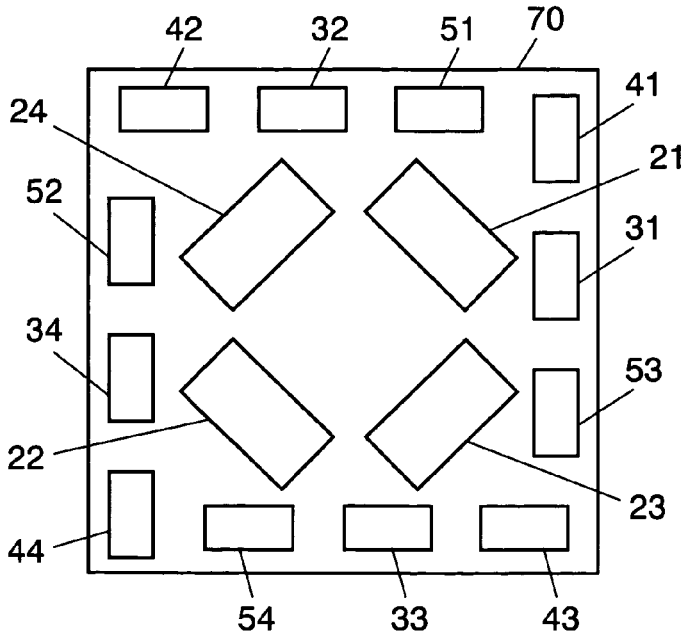
FIG. 2 is a layout diagram of electronic components of the high-frequency switch in accordance with the exemplary embodiment of the present invention.
Figure 3A:
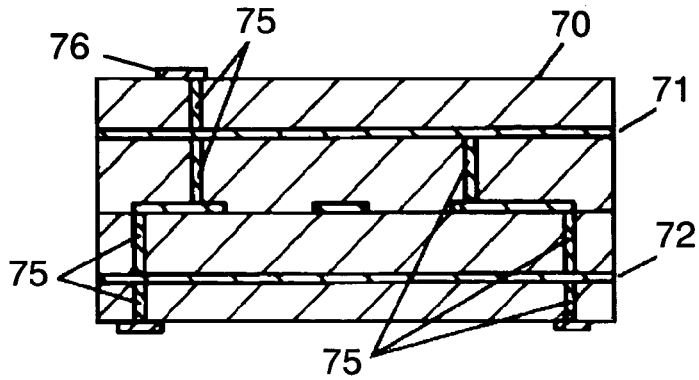
FIG. 3A is a sectional view of the high-frequency switch in accordance with the exemplary embodiment of the present invention.
Figure 3B:
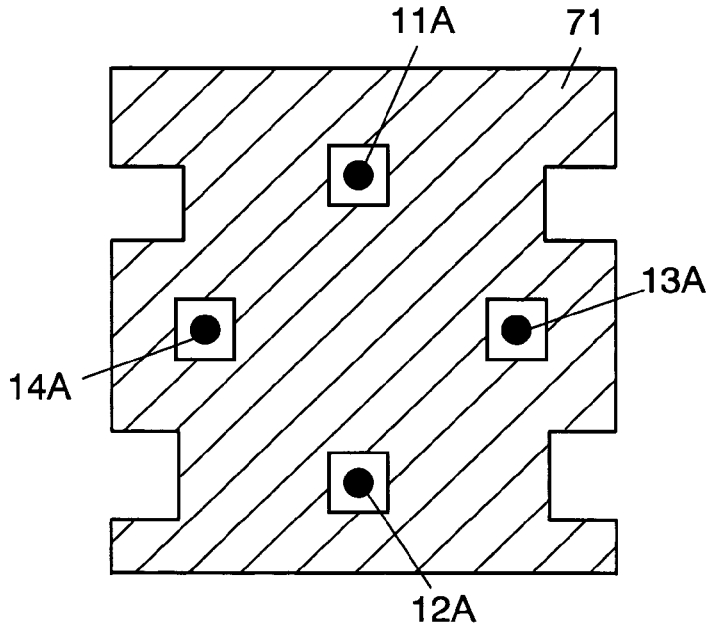
FIG. 3B is a drawing showing a ground pattern on a second layer of a circuit board shown in FIG. 3A.

FIG. 2 is a layout diagram of electronic components mounted on the surface of circuit board (board) 70 that constitutes a high-frequency switch. Terminals 11 and 12 are provided along a first side of board 70, and terminals 13 and 14 along a second side opposite to the first side. FIG. 3A is a sectional view of respective layers of board 70. FIG. 3B shows ground pattern 71 on the second layer of the board. Electrodes 11A, 12A, 13A, and 14A are respectively connected to four connection electrodes 76 on the surface layer for mounting PIN diodes 21, 22, 23, and 24, via via-holes 75.

Figure 3C:
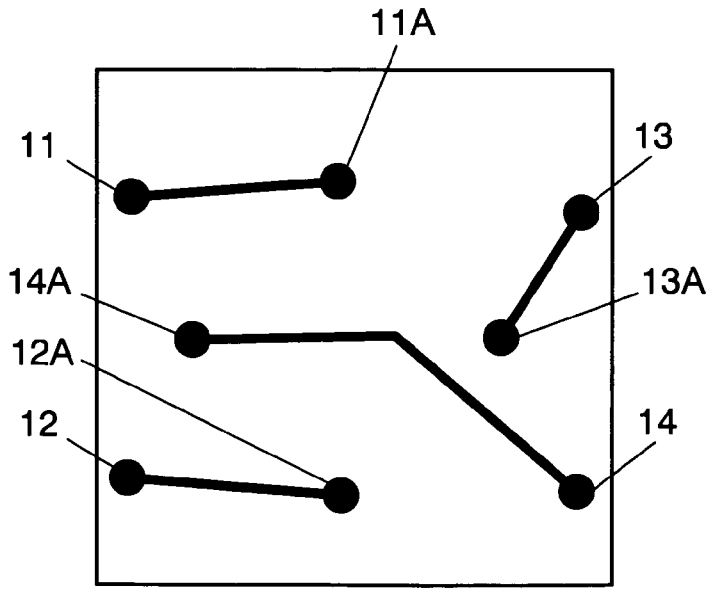
FIG. 3C is a drawing showing a wiring pattern on a third layer of the circuit board shown in FIG. 3A.
Figure 3D:
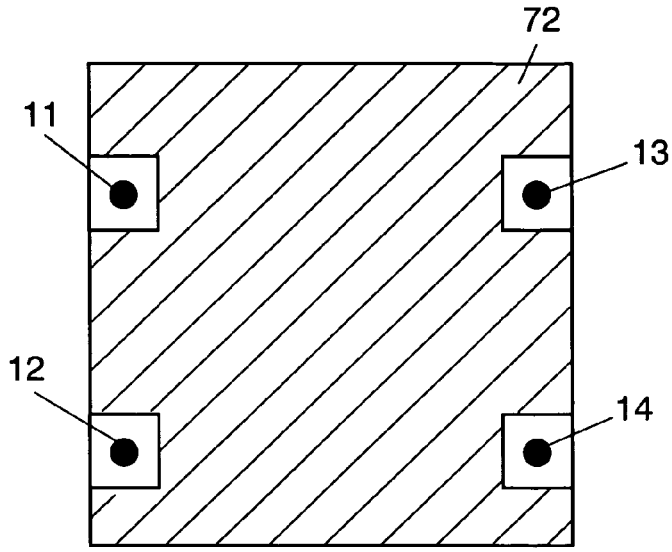
FIG. 3D is a drawing showing a ground pattern on a fourth layer of the circuit board shown in FIG. 3A.
Figure 3E:
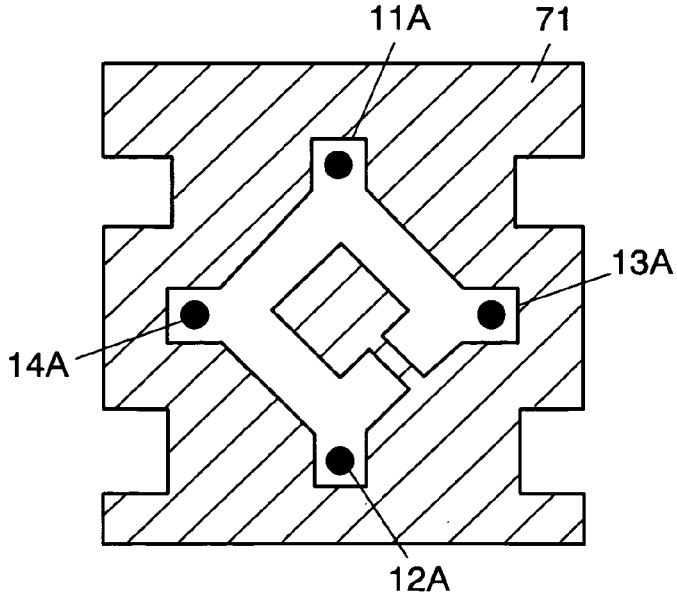
FIG. 3E is a drawing showing another ground pattern on the second layer of the circuit board shown in FIG. 3A.

As shown in FIG. 1, a switch using PIN diodes has a large number of components constituting peripheral circuits. Because these components generate stray capacitance, matching especially in a high frequency band is difficult when the switch is used for a broad band. This increases a transmission loss and deteriorates performance. Especially with a switch for a high frequency band, ground layers must be inserted into various places to ensure isolation between respective terminals. Thus, this phenomenon is conspicuous. To prevent this phenomenon, especially, ground pattern 71 is not formed directly under electrodes 76 for mounting PIN diodes 21, 22, 23, and 24, as shown in FIG. 3B. When the switch is used in an extremely high frequency band, it is preferable that no grand pattern 71 is formed directly under the portions for mounting PIN diodes 21, 22, 23, and 24, as shown in FIG. 3E. Of course, it is effective to form no ground pattern 71 directly under any one of PIN diodes. These structures prevent stray capacitance generated around electrodes 76 and ensures the characteristics of the high-frequency switch. FIG. 3C shows a wiring pattern on the third layer. In this pattern, wirings are formed from terminals 11 and 12, i.e. input electrodes, and terminals 13 and 14, i.e. output electrodes, to electrodes 11A, 12A, 13A, and 14A to connect the terminals to the corresponding PIN diodes. FIG. 3D shows ground pattern 72 on the fourth layer. Terminals 11, 12, 13, and 14 are connected to external connection electrodes (not shown) formed on the lowermost layer.

The patterns formed on respective layers are electrically connected by via-holes 75 as shown in FIG. 3A. Ground patterns 71 and 72 formed upper and lower layers, respectively, shield the wiring pattern of FIG. 3C from high frequency noises and ensure the characteristics of the high-frequency switch.

As obvious from FIGS. 3C and 2, each side of the quadrangle made by connecting terminals 11 through 14 disposed along the outer periphery of board 70 is not parallel to the corresponding side of the quadrangle made by connecting four connection electrodes 76 that are connected to electrodes 11A and 14A for mounting PIN diodes 21 through 24. That is, corresponding sides of these two quadrangles form an angle other than 180°. In the example of FIG. 3C, corresponding sides form an angle of 45°. However, to shorten the transmission line, another angle can be used.

Figure 4:
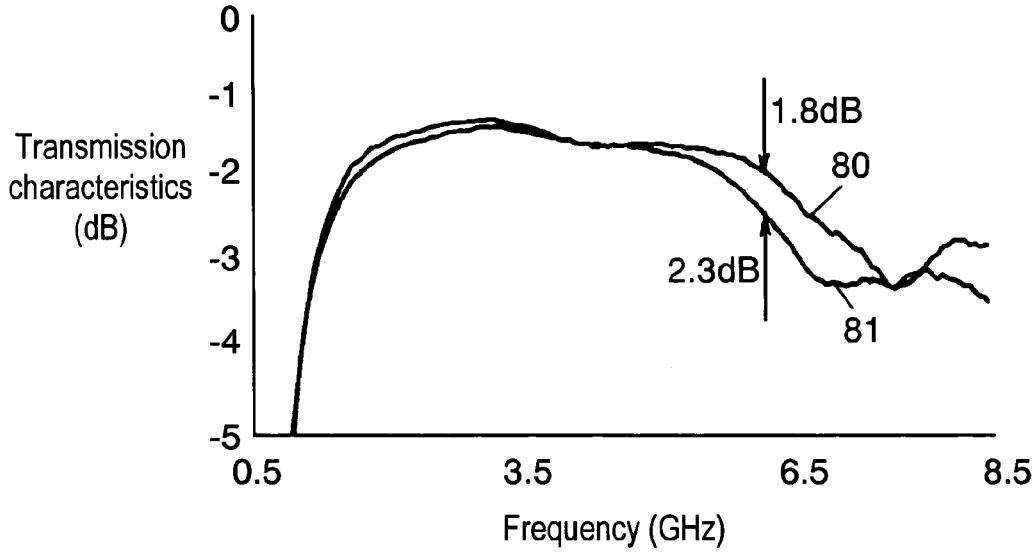
FIG. 4 is a graph for comparison of transmission characteristics between a high-frequency switch in accordance with the exemplary embodiment of the present invention and a conventional high-frequency switch.
Figure 5:
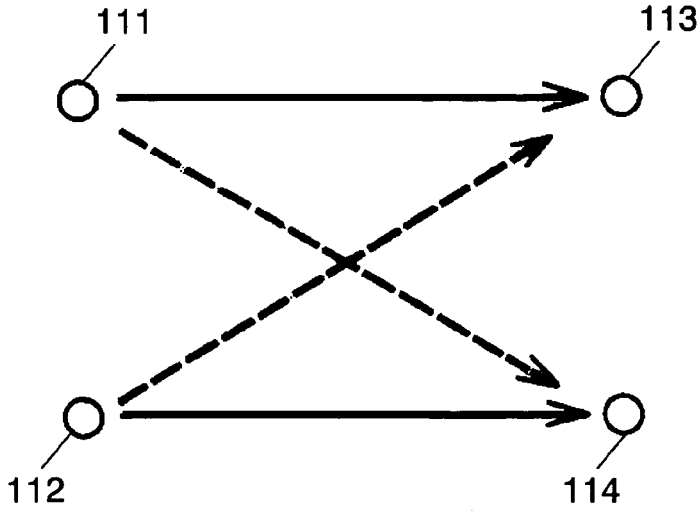
FIG. 5 is a schematic diagram showing an idea of a high-frequency switch having two input terminals and two output terminals.
Figure 6:
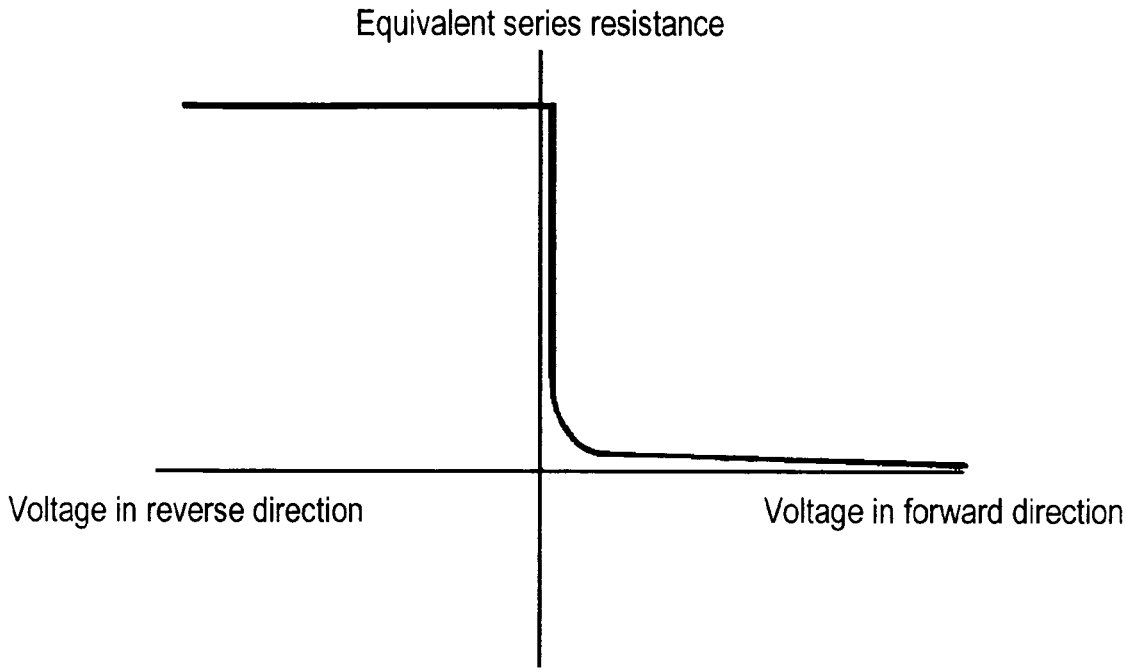
FIG. 6 shows characteristics of a PIN diode.
Figure 7:
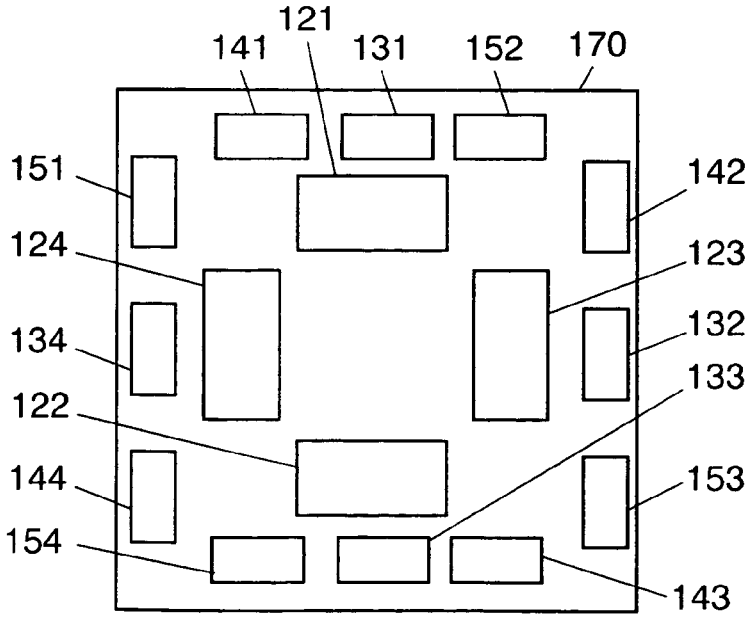
FIG. 7 PRIOR ART
FIG. 7 is a layout diagram of electronic components of a conventional high-frequency switch.
Figure 8:
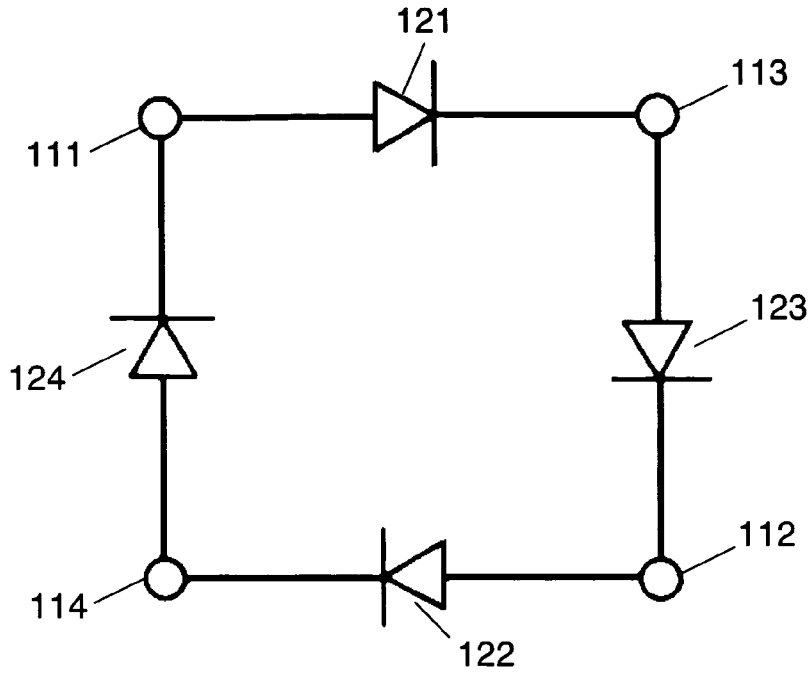
FIG. 8 is a circuit diagram of PIN diodes in the high-frequency switch of FIG. 5.
Figure 9:
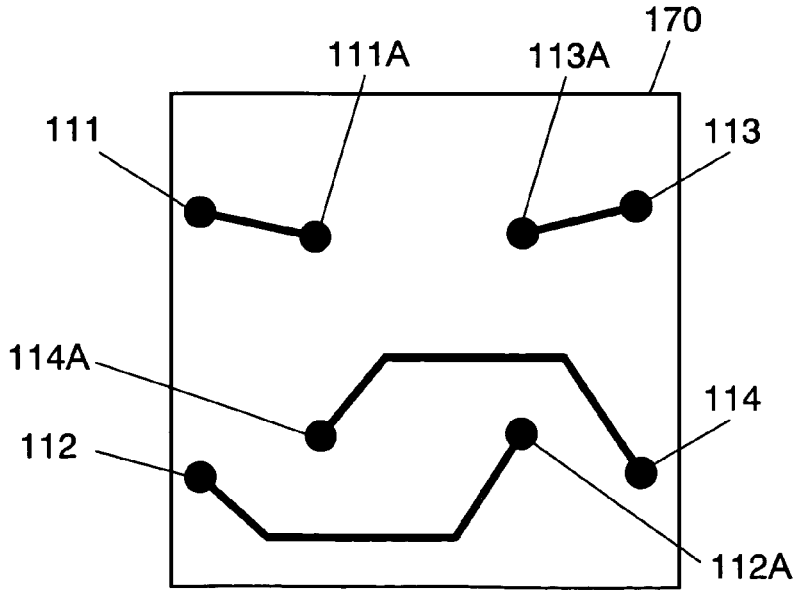
FIG. 9 PRIOR ART
FIG. 9 is a circuit diagram of the high-frequency switch of FIG. 7.

The characteristics of the switch of the structure described above are compared with those of the conventional switch structured as shown in FIGS. 7 and 9. FIG. 4 is a graph showing the relation between frequency and transmission characteristics. Characteristics curve 80 shows a loss in the paths of terminals 11 through 14 of this embodiment. Characteristics curve 81 shows a loss in the paths of terminals 111 through 114 in FIG. 9. In the structure of FIG. 9, each side of the quadrangle made by connecting terminals 111 through 114 disposed along the outer periphery of board 170 is substantially parallel to the corresponding side of the quadrangle made by connecting electrodes 111A through 114A for mounting PIN diodes 121 through 124. At low frequencies up to 4 GHz, both losses have substantially no difference. However, the losses at a frequency of 6 GHz, for example, are different. The loss is 1.8 dB in this embodiment, while the loss is 2.3 dB in the conventional structure. Thus, the transmission loss has reduced by 0.5 dB.

The above description shows that the length of the transmission line largely varies with the configuration of PIN diodes and the resulting mismatching causes a transmission loss in the paths. Disposing and connecting PIN diodes in a manner shown in this embodiment can reduce the transmission loss in the paths.

Meanwhile, by-pass capacitors 41, 42, 43, and 44 mounted on board 70 in FIG. 2 can be incorporated into board 70. Because board 70 is structured of a laminate made of at least two layers of dielectric material, such a structure is possible. At that time, it is preferable to use a ceramic board having a higher dielectric constant than a resin board. Additionally, by using ceramic boards having different dielectric constants, by-pass capacitors further suitable for high frequency characteristics can be formed inside of the laminate. This structure can reduce the number of components and the area for mounting components, thus the high-frequency switch is further downsized.

In this embodiment, board 70 is shown as a quadrangle. However, the board can be a shape having corners notched, or a smooth arc shape. The board can be shaped as a polygon other than a quadrangle and input electrodes and output electrodes can be formed along two different sides.

In this embodiment, terminals 11 and 12 on the input side and terminals 13 and 14 on the output side are provided along opposite sides of board 70. In general, such a structure is preferable for designing equipment. However, for board 70 shaped as a quadrangle, input electrodes and output electrodes can be formed along two adjacent sides.

Meanwhile, although passive components, e.g. by-pass capacitors and resistors, are assembled onto the same board 70 as PIN diodes, these passive components can be disposed on another board. However, to shorten the transmission line and structure a compact high-frequency switch, it is preferable to dispose the passive components on the same board as the PIN diodes.

As described above, a high-frequency switch of the present invention has a circuit board and PIN diodes mounted thereon. The board has two input electrodes along one side and two output electrodes along another side. Each side of the quadrangle made by connecting the input electrodes and the output electrodes is not parallel to the corresponding side of the quadrangle made by connecting electrodes for mounting the PIN diodes. This structure reduces a transmission loss in the paths and facilitates impedance matching.

What is claimed is:

1. A high-frequency switch comprising:

a circuit board having two input electrodes along a first side, two output electrodes along a second side, and four connection electrodes on a surface thereof, and the circuit board comprising a laminate including a first layer having the connection electrodes formed thereon and a second layer under the first layer, the second layer having a ground pattern formed thereon in a portion other than a place directly under the connection electrodes; and four p-intrinsic-n (PIN) diodes connected to the corresponding four connection electrodes;

wherein each side of a quadrangle made by connecting the two input electrodes and the two output electrodes is at an angle other than 180° to a corresponding side of a quadrangle made by connecting the four connection electrodes.

2. A high-frequency switch comprising:

a circuit board having two input electrodes along a first side, two output electrodes along a second side, and four connection electrodes on a surface thereof, and the circuit board comprising a laminate including a first layer having the connection electrodes formed thereon and a second layer under the first layer, the second layer having a ground pattern formed thereon in a portion other than a place directly under the connection electrodes and at least one of the four PIN diodes; and four p-intrinsic-n (PIN) diodes connected to the corresponding four connection electrodes;

wherein each side of a quadrangle made by connecting the two input electrodes and the two output electrodes is at an angle other than 180° to a corresponding side of a quadrangle made by connecting the four connection electrodes.

3. A high-frequency switch comprising:

a circuit board having two input electrodes along a first side, two output electrodes along a second side, and four connection electrodes on a surface thereof, the circuit board comprising a laminate including a first layer having a signal pattern connecting the two input electrodes and the two output electrodes to the four connection electrodes and a second layer and a third layer each having a ground pattern and sandwiching the first layer; and four p-intrinsic-n (PIN) diodes connected to the corresponding four connection electrodes;

wherein each side of a quadrangle made by connecting the two input electrodes and the two output electrodes is at an angle other than a 180° to a corresponding side of a quadrangle made by connecting the four connection electrodes.

4. The high-frequency switch of claim 3, wherein the circuit board further includes a fourth layer, the fourth layer having the connection electrodes formed thereon, the circuit board being provided on a side of the second layer opposite to the first layer.

5. A high-frequency switch comprising:

a circuit board having two input electrodes along a first side, two output electrodes along a second side, and four connection electrodes on a surface thereof; and four p-intrinsic-n (PIN) diodes connected to the corresponding four connection electrodes;

wherein each side of a quadrangle made by connecting the two input electrodes and the two out put electrodes is substantially at 45° to a corresponding side of a quadrangle made by connecting the four connection electrodes.

6. The high-frequency switch of claim 5, further comprising a passive component for controlling at least one of the four PIN diodes.

7. The high-frequency switch of claim 5, wherein the first side is opposite to the second side.

8. The high-frequency switch of claim 5, wherein the circuit board comprises a laminate made of a plurality of dielectric materials.

9. The high-frequency switch of claim 8, wherein the plurality of dielectric materials are ceramics.

10. The high-frequency switch of claim 8, wherein the plurality of dielectric materials have different dielectric constants.

11. The high-frequency switch of claim 8, wherein the circuit board is made of a laminate, the laminate including:

a first layer having the connection electrodes formed thereon; and a second layer under the first layer, the second laminate layer having a ground pattern formed thereon.

* * * * *